US006964254B1

(12) United States Patent
Koerner et al.

(10) Patent No.: US 6,964,254 B1
(45) Date of Patent: Nov. 15, 2005

(54) APPARATUS AND METHOD OF CONDITIONING AN ENGINE FOR STORAGE

(75) Inventors: Scott A. Koerner, Kenosha, WI (US); George L. Broughton, Wadsworth, IL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/708,079

(22) Filed: Feb. 6, 2004

(51) Int. Cl.[7] ..... F01M 1/16
(52) U.S. Cl. ..... 123/196 R
(58) Field of Search ..... 123/196 R, 73 AD, 123/41.14, 198 A, 196 S; 440/88 N, 88 R

(56) References Cited

U.S. PATENT DOCUMENTS

| | | | | |
|---|---|---|---|---|
| 4,271,874 | A | | 6/1981 | Brady |
| 4,986,319 | A | | 1/1991 | Ahlefeld |
| 5,035,208 | A | | 7/1991 | Culp |
| 5,069,259 | A | | 12/1991 | Ahlefeld |
| 5,263,885 | A | | 11/1993 | Montague |
| 5,355,851 | A | * | 10/1994 | Kamiya ..... 123/196 R |
| 5,538,031 | A | | 7/1996 | Brence et al. |
| 5,577,274 | A | | 11/1996 | Plotsky et al. |
| 5,727,514 | A | | 3/1998 | Sunden |
| 5,902,159 | A | | 5/1999 | Killpack et al. |
| 6,206,740 | B1 | | 3/2001 | Sholler |
| 6,264,517 | B1 | | 7/2001 | Limoli et al. |
| 6,283,072 | B1 | * | 9/2001 | Lavy et al. ..... 123/73 AD |
| 6,374,708 | B1 | | 4/2002 | Kunz |
| 6,510,862 | B2 | | 1/2003 | Prentice |
| 6,792,910 | B2 | * | 9/2004 | Haman et al. ..... 123/196 R |

* cited by examiner

*Primary Examiner*—Henry C. Yuen
*Assistant Examiner*—Hyder Ali
(74) *Attorney, Agent, or Firm*—BRP Legal Services

(57) ABSTRACT

An apparatus and method for conditioning an internal combustion engine for storage is disclosed. The engine includes an ECU that is programmed to initiate an auto-fogging procedure. The auto-fogging procedure automatically introduces increased amounts of lubricating oil into the engine thereby coating the cylinders and some of the internal components of the engine with a protective film of oil for storage.

35 Claims, 5 Drawing Sheets

APPARATUS AND METHOD OF CONDITIONING AN ENGINE FOR STORAGE

BACKGROUND OF INVENTION

The present invention relates generally to internal combustion engines, and more particularly, to an apparatus and method of conditioning an engine for extended periods of non-use.

When preparing an internal combustion engine for extended periods of storage, such as one incorporated into an outboard motor, it is often desired to drain any untreated water from the engine, treat any remaining water with an anti-freezing agent, drain the fuel system or treat the fuel in the fuel system with a stabilizer, and introduce increased amounts of lubrication into the internal areas of the engine. This entire process is often called "winterizing" an engine. Although generally referred to as "winterizing" an engine, the above process is not season specific and can be beneficial to any engine that will not be operated for extended periods of time. The step of introducing increased amounts of lubrication into the engine is often referred to as "fogging" the engine. Fogging involves introducing a winterizing/lubricating oil into the combustion chamber of a running engine. A portion of the lubricating oil is burned during the combustion process before the engine is shut down and often results in a heavy smoke, or fog, from the engine exhaust.

The lubricating oil can be introduced directly into the engine through the engine air intakes, into the fuel injection air tubes while the engine is running, or into the oil injection system of an engine so equipped. The process of injecting the lubricating oil into the internal combustion engine coats the inside components of the engine with a protective film of lubricating oil. The film of oil protects the bearings and internal metal surfaces of the engine from condensation and rust that may result during extended periods of non-operation.

Preparing an engine for storage by introducing increased amounts of oil into the engine is a time consuming and labor intensive process. An operator must continually manipulate the engine throttle and the amount of lubricating oil introduced into the engine in order to keep the engine running. The engine should be running in order to fully distribute the lubricating oil about the interior surfaces and components of the engine. Additionally, the engine will be choked out if too much lubricating oil is introduced into the engine too quickly or if the engine is operated at too low a speed. A user must continually adjust the amount of lubricating oil introduced into the engine and the engine's operating speed in order to keep the engine running until a desired amount of lubricating oil is run therethrough.

Another problem with introducing too much lubricating oil into an engine is subsequent starting of the engine. Too much lubrication introduced into the engine during the storage process can make the engine difficult to start after storage, can result in premature fouling of the spark plugs, and can determinately affect the engine exhaust systems. Conversely, not introducing enough oil can result in poor coverage and inadequate protection to key components of the engine.

It would therefore be desirable to have an apparatus and method capable of automatically introducing a predetermined amount of lubricating oil into an internal combustion engine in preparation for storage of the engine.

BRIEF DESCRIPTION OF INVENTION

The present invention provides an apparatus and method of introducing an increased amount of lubricant into an engine that solves the aforementioned problems. An engine is disclosed which includes an electronic control unit (ECU) that is programmed to, upon commencement, perform a storage preparation procedure wherein increased amounts of lubricating oil are introduced into the engine automatically.

In accordance with one aspect of the present invention, an engine is disclosed having a block with at least one cylinder formed therein. An oil injector in fluid communication with an oil supply is connected to the engine to provide lubricating oil to the cylinder. The engine has an ECU programmed to control an amount of oil introduced into the engine wherein, a first amount of oil is introduced into the engine based on a normal operation, and a second amount of oil, greater than the first amount of oil, is introduced into the engine based on a storage preparation operation.

According to another aspect of the present invention, an outboard motor is disclosed having an engine, a midsection extending from the engine, and a gearcase attached to the midsection. A propeller shaft extends from the gearcase and is constructed to be driven by the engine. The outboard motor has an ECU programmed to initiate an oil delivery to the engine during engine operation and constructed to receive a storage signal. In response to the storage signal, the ECU is further programmed to initiate an auto-fogging procedure.

According to a further aspect of the present invention, a method of preparing an engine for storage is disclosed which includes the steps of: providing an ECU with a storage routine, initializing the storage routine, and increasing an amount of lubricant introduced into an engine during the storage routine.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
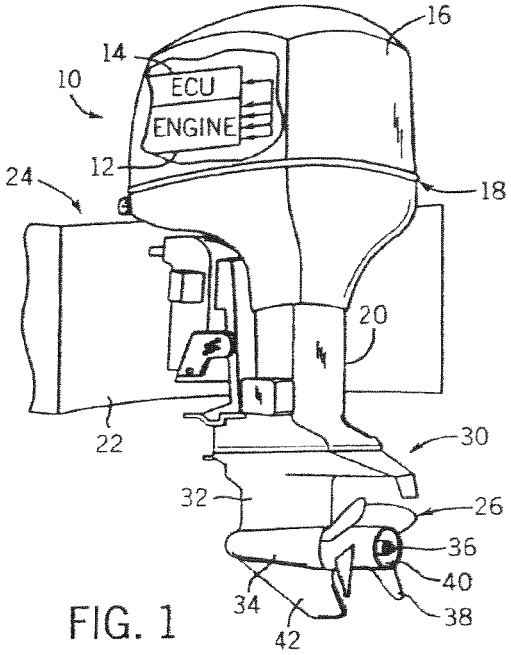
FIG. 1 is a perspective view of an exemplary outboard motor incorporating the present invention.

The present invention relates generally to internal combustion engines, and preferably, those incorporating direct fuel injection in a spark-ignited two-cycle gasoline-type engine. FIG. 1 shows an outboard motor 10 having one such engine 12 controlled by an electronic control unit (ECU) 14 under engine cover 16. Engine 12 is housed generally in a powerhead 18 and is supported on a midsection 20 configured for mounting on a transom 22 of a boat 24 in a known conventional manner. Engine 12 is coupled to transmit power to a propeller 26 to develop thrust and propel boat 24 in a desired direction. A lower unit 30 includes a gearcase 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via midsection 20. A skeg 42 depends vertically downwardly from torpedo section 34 to protect propeller fins 38 and encourage the efficient flow of outboard motor 10 through water.

Figure 2:
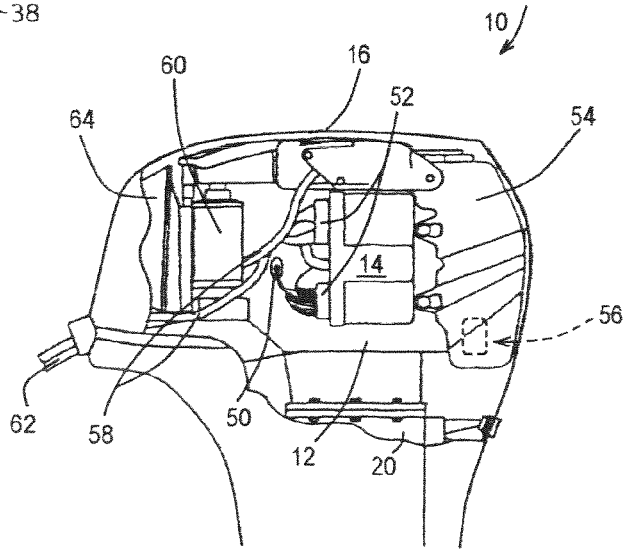
FIG. 2 is an elevational view of the outboard motor of FIG. 1 with a portion of the cover removed therefrom.

FIG. 2 shows outboard motor 10 with a portion of cover 16 removed exposing a portion of engine 12. ECU 14 is mounted to engine 12 and is programmed to control the operation of engine 12. ECU 14 is in communication with a variety of engine sensors 50 via a plurality of multi-pin connectors 52. Engine sensors 50 include a plurality of specific sensors, some of which include a throttle position sensor, engine temperature sensor, intake air temperature sensor, oil pressure sensor, oil level sensor, or a transmission position sensor.

During operation of engine 12, ECU 14, controls spark plug firing, fuel injector operation, and lubricating oil injection. It is understood that these are but a few examples of the systems of engine 12 that ECU 14 controls. Engine 12 includes an oil reservoir 54 with an oil pump 56 disposed therein. Oil pump 56 supplies oil from oil reservoir 54 to engine 12 via a plurality of oil passages 58. A plurality of oil injectors (not shown) are controlled by ECU 14 and in fluid communication with oil passages 58 and an interior of engine 12. Such a construction allows ECU 14 to control an amount of oil introduced and/or timing of the introduction of the oil into the engine.

A starter 60 is activated directly by an ignition switch responsive to an operator input. A plurality of connection cables 62 route battery power and the ignition switch lines to the starter and the engine, for motors so equipped. During operation of engine 12, combustion air enters engine 12, in part, through an air intake assembly 64. ECU 14 monitors the amount and temperature of combustion air provided to engine 12 through air intake assembly 64 via a temperature sensor and a throttle position sensor located thereabout.

Figure 3:
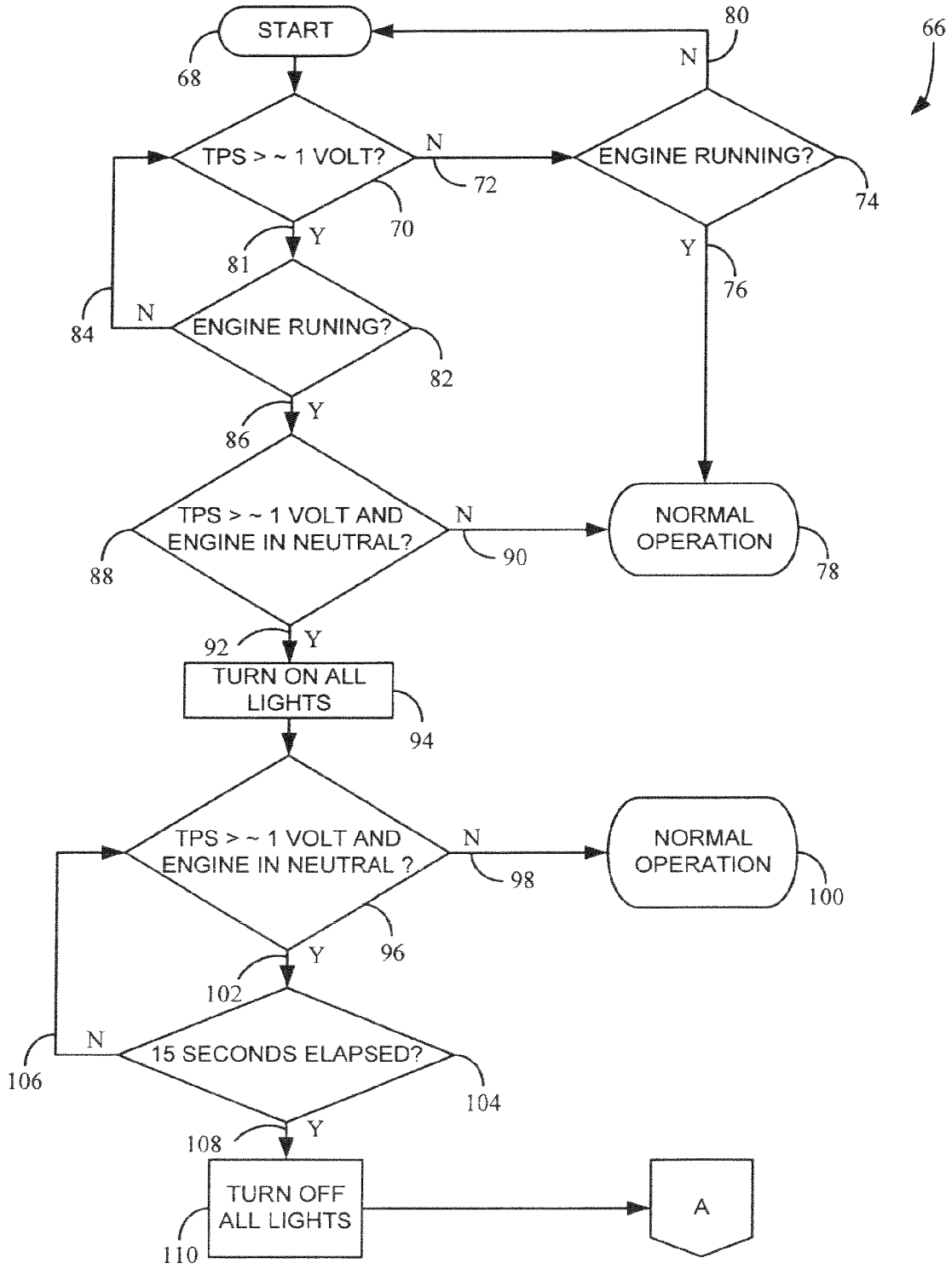
FIGS. 3 and 4 are flow charts representing an aspect of the present invention.
Figure 4:
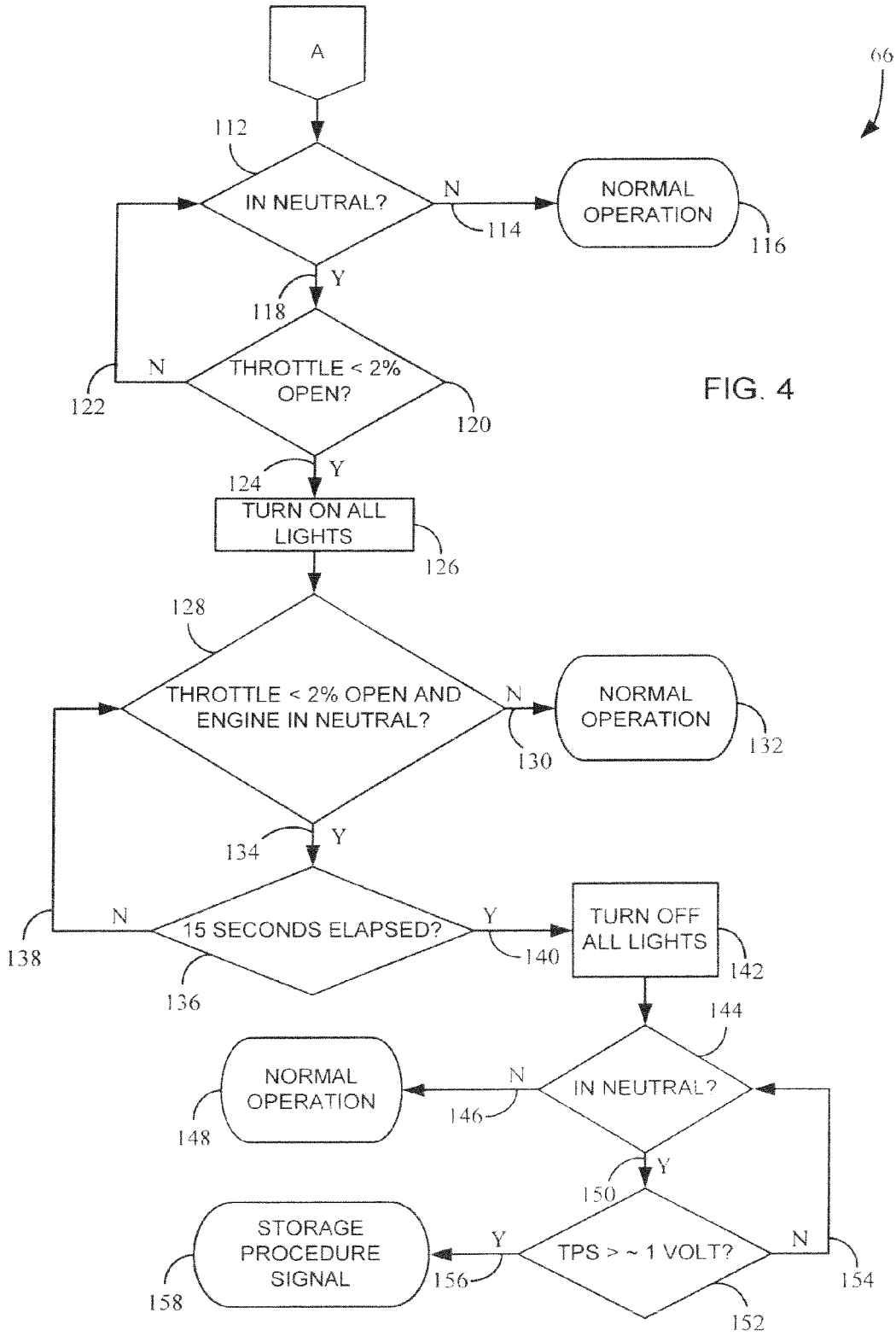

ECU 14 can initiate and effectuate a storage procedure commencement routine 66, as shown in FIGS. 3 and 4, partly because of its integration with the physical systems of engine 12. Storage procedure commencement routine 66 initiates at start 68 that coincides with an operator initiated start of engine 12. After start 68, routine 66 checks a throttle position sensor (TPS) voltage 70. If throttle position sensor voltage 70 is not greater than approximately 1 volt at 70, 72, routine 66 verifies an engine status 74 as engine running. If the engine is running 74, 76, routine 66 proceeds to normal operation 78 and supplies a normal amount of oil as deemed necessary to lubricate the engine under normal operating conditions.

If the engine is not running 74, 80, routine 66 returns to start 68 and proceeds to check throttle position sensor voltage 70. If the throttle position sensor voltage is now greater than approximately 1 volt at 81, routine 66 verifies engine running 82 and if the engine is not running 84, routine 66 returns to check throttle position sensor voltage 70. If the engine is running at 82, 86, routine 66 next determines if both the throttle position sensor voltage is greater than approximately 1 volt and the engine is in neutral 88. Additionally, although routine 66 verifies an engine in neutral condition, it is understood that the present invention is equally applicable for applications that do not have a transmission coupled to the engine. If either the throttle position sensor signal is less than approximately 1 volt or the engine is not in neutral 88, 90, routine 66 continues with normal operation 78. If the throttle position signal is greater than approximately 1 volt and the engine is in neutral 88, 92, ECU 14 turns on a series of indicator lights 94 to indicate commencement of the storage conditioning process. Although disclosed as an optical indicator, i.e. lights, it is equally understood that an acoustical indicator that is audible to an operator over the noise of the engine would be equally effective.

After turning on lights 94, routine 66 confirms that the throttle position sensor signal is greater than approximately 1 volt and the engine is in neutral 96. If such is not the case 96, 98, engine 12 continues in normal operation 100. If the throttle position sensor signal is greater than approximately 1 volt and the engine is in neutral 96, 102, routine 66 initiates a wait loop of 15 seconds at 104, 106. It is understood that the 15 second duration of wait loop 104 is only by way of example. If 15 seconds has not elapsed 104, 106, routine 66 continues to determine if the throttle position sensor signal is greater than approximately 1 volt and the engine is still in neutral 96. When 15 seconds has elapsed 104, 108, routine 66 turns off lights 110.

With the lights off 110, routine 66 rechecks transmission position 112, shown in FIG. 4, and if the transmission position is not in neutral 112, 114, routine 66 continues in normal operation 116. If the transmission position is in neutral 112, 118, routine 66 checks throttle position 120. If throttle position 120 indicates that the throttle is more than approximately 2% open 122, routine 66 returns to recheck transmission position 112 until check throttle position 120 indicates that the throttle is less than approximately 2% open 124, and then turns on lights 126. Having turned on lights 126, routine 66 confirms the throttle position and that the engine is in neutral at 128, and if either the throttle is equal to or greater than 2% open, or the engine is not in neutral, 128, 130, the engine continues in normal operation 132. If the throttle position is less than approximately 2% open and the engine remains in neutral 128, 134, another wait loop is initiated at 136. If both conditions of throttle position and neutral position are not maintained for approximately 15 seconds 128, 136, 138, routine 66 proceeds in normal operation 132. If throttle and neutral positions are maintained 128, 134 for time verification 136, 140, routine 66 turns off lights 142.

Having now flashed the lights twice, routine 66 again verifies neutral position 144, and if neutral condition is not maintained 144, 146, routine 66 proceeds in a normal operation 148. If neutral position is maintained 144, 150, routine 66 verifies throttle position sensor voltage at 152. If throttle position sensor voltage is less than approximately 1 volt at 152, 154, routine 66 returns to verify neutral position 144. If throttle position sensor signal is greater than approximately 1 volt at 152, 156, storage preparation commencement routine 66 is successfully completed and ECU 14 initiates storage procedure signal 158. As such, storage preparation commencement routine 66 allows an operator of an engine so equipped to initiate the storage process by moving the throttle as disclosed and maintaining that throttle position for a predetermined time, as indicated by the indicator lights while maintaining the engine/transmission in the neutral position. This series of throttle movements, each uninterrupted for a defined time, are not movements that would typically be associated with normal operation and are therefore interpreted as a request to initiate the storage routine. It is understood that in certain applications of the present invention that the neutral requirement may be eliminated, such as in PWCs or lawn and garden equipment, for example.

Storage preparation commencement routine 66 allows ECU 14 to control the introduction of an increased amount of lubricating oil into the engine. As such, after an operator has completed storage preparation commencement routine 66, ECU 14 automatically operates and controls the operation of engine 12 thereby fully automating the storage procedure. Additionally, by controlling operation of the status indicator lights 94, 110, 126, and 142, ECU 14 can be instructed to initiate the storage preparation commencement routine without any external instrumentation or diagnostic tooling. Alternatively, it is equally understood that in addition to the storage preparation commencement routine 66 disclosed above, it may, at times, be beneficial to allow service personnel, having electronically connected diagnostic tooling to engine 12, to initiate the storage procedure with the diagnostic tooling. Such a routine is shown in FIG. 5.

Figure 5:
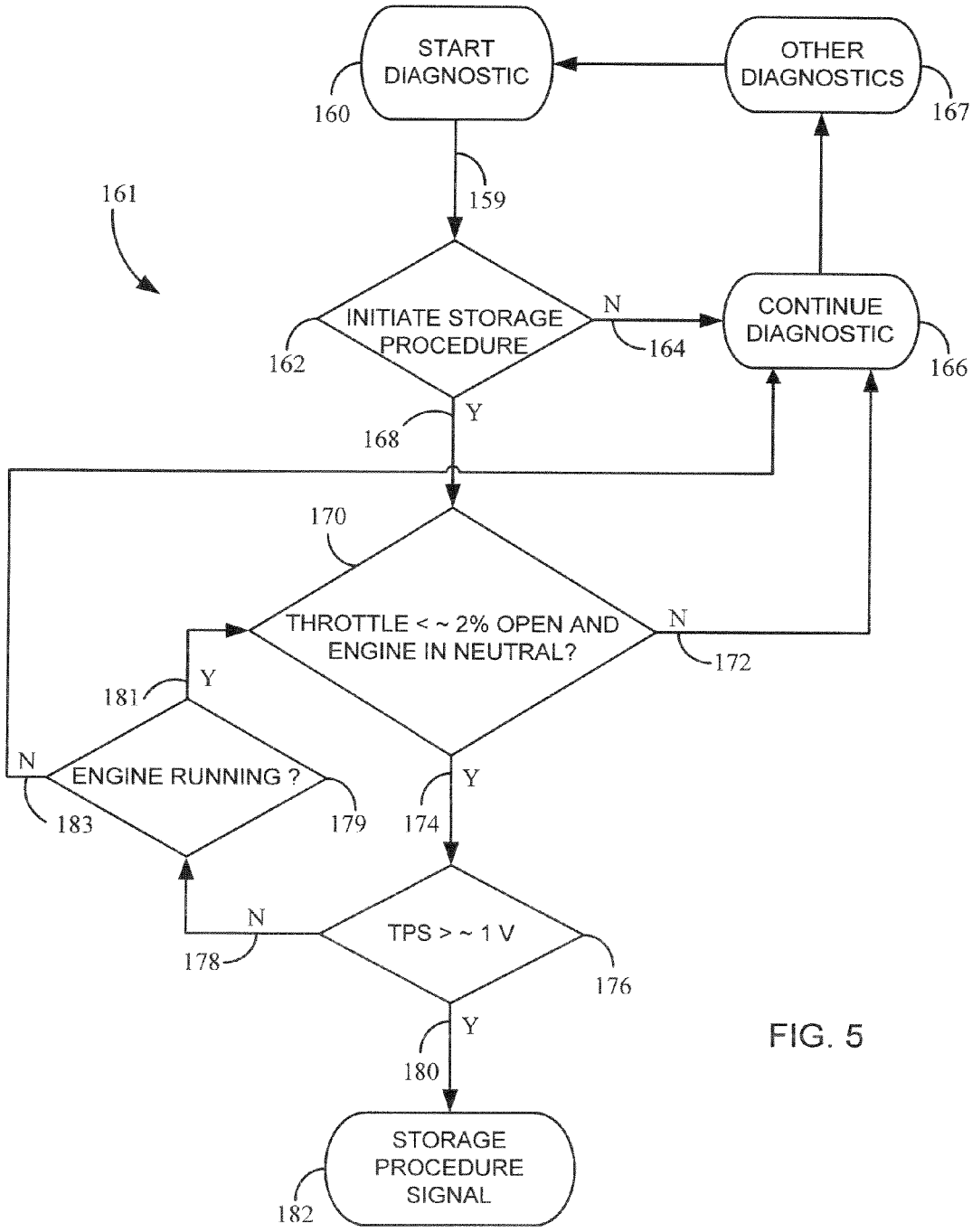
FIG. 5 is a flow chart of an alternate to the storage procedure commencement routine shown in FIGS. 3 and 4.

As shown in FIG. 5, with engine 12 running at idle while in neutral, a command 159 is given from a diagnostic tool 160 to initiate a diagnostic initiated storage procedure commencement routine 161. Routine 161 verifies the initiation of storage procedure 162. If there is no signal to initiate storage procedure 162, 164, routine 161 continues diagnostic analysis 166 and exercising of other engine diagnostics at 167. If the storage procedure is initiated 162, 168, ECU 14 determines a throttle position less than approximately 2% open and an engine in neutral condition 170. If the throttle is open more than approximately 2% or the engine is not in neutral 170, 172, routine 161 continues diagnostic analysis 166. If the throttle is less than approximately 2% open and the engine is in neutral 170, 174, routine 161 determines a throttle position sensor value 176. If the throttle position sensor value is less than approximately 1 volt at 176, 178, routine 161 determines if the engine is running at 179. If the engine is running 179, 181, returns to check throttle position less than 2% open and engine in neutral condition 170. If the engine is deemed not to be running 179, 183, routine 161 continues with diagnostic analysis at 166. If the throttle position sensor value is greater than approximately 1 volt at 176, 180, routine 161 generates storage procedure signal 182 and initiates storage procedure 184 of FIG. 6.

Figure 6:
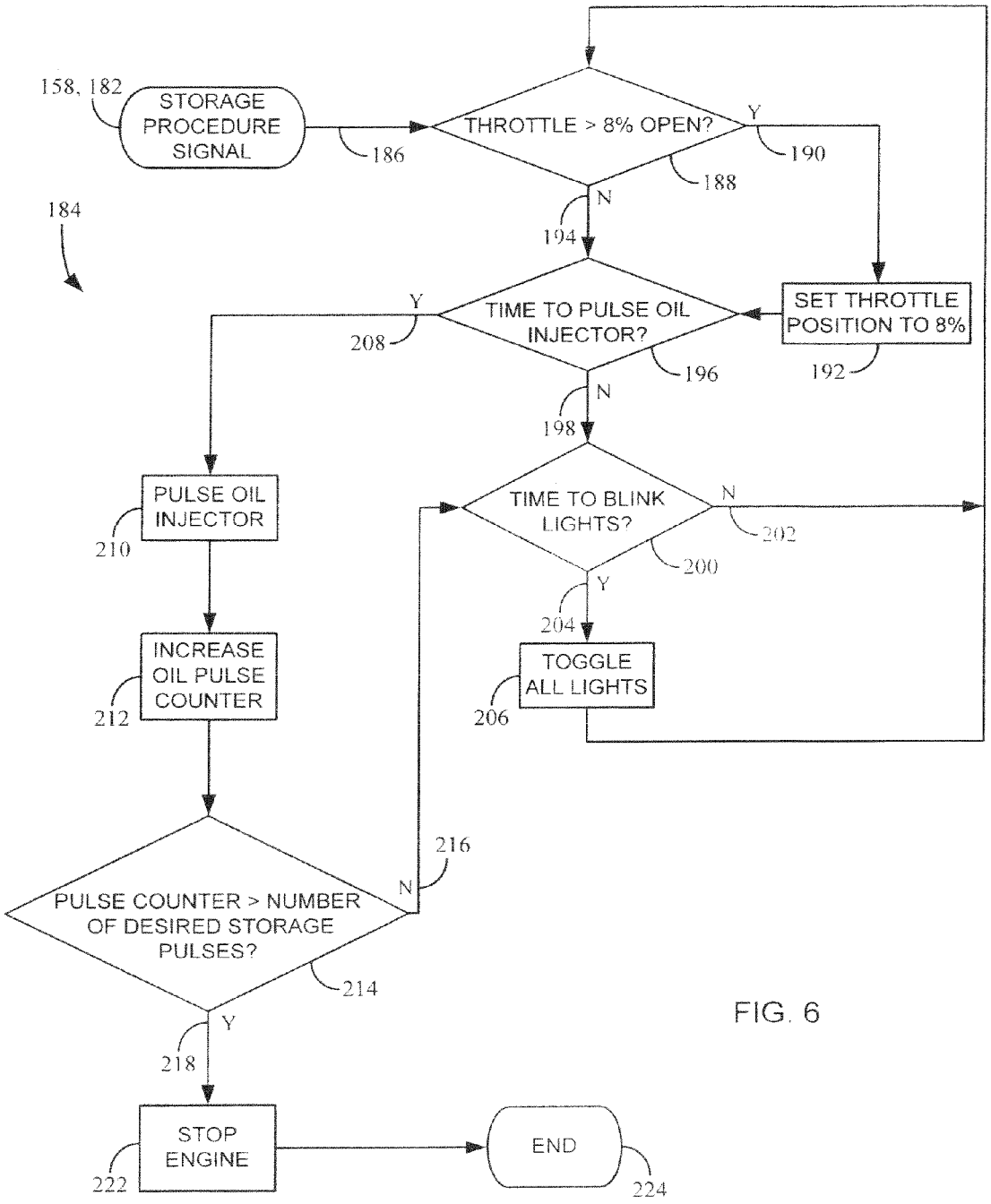
FIG. 6 is a flow chart of a storage procedure initiated by the storage procedure commencement routine of FIGS. 3 and 4 or FIG. 5.

As shown in FIG. 6, upon the generation of storage procedure signal 158, 182, storage procedure 184 verifies throttle position 188. If throttle position 188 indicates that a throttle position is greater than 8% open 188, 190, ECU 14 sets the throttle position to 8% at 192. It is understood that a throttle position of 8% is only an example of a throttle position and a throttle position of 6% open, for example, would be just as effective. After the throttle position is set to 8% at 192, or if the throttle position is initially less than approximately 8% open at 188, 194, storage procedure 184 verifies if it is time to pulse the oil injector 196. That is, since the oil injector is pulsed at a predetermined frequency, such as 5 Hz, a first part of a loop is initiated at 196 to check the time to a next pulse A second part of the loop is initiated at 200 to check if it is time to blink the lights, which are toggled every ½ second. If it is not time to pulse oil injector 196, 198, storage procedure 184 verifies if it is time to blink lights 200. If it is not time to blink lights 200, 202, storage procedure 184 returns to verify throttle position 188. Once it is time to blink lights 200, 204, storage procedure 184 toggles all lights 206 prior to returning to verify throttle position 188.

After toggling the lights 206, if it is time to pulse injector 196, 208, storage procedure 184 pulses an oil injector 210 and increments an oil pulse counter 212. Storage procedure 184 next verifies whether the pulse counter has reached the number of desired storage pulses 214. If the pulse counter is not greater than or equal to the number of desired storage pulses 214, 216, storage procedure 184 returns to the second part of the loop to check if it is time to blink lights 200. If the pulse counter is greater than or equal to the number of desired storage pulses 214, 218, storage procedure 184 automatically stops engine 222 and exits storage procedure 184 at end 224. Upon completion of storage procedure 184, increased amounts of lubrication have been run through engine 12 thereby optimally conditioning the engine for an extended period of non-operation.

Therefore, according to a first embodiment of the present invention, an engine includes a block with at least one cylinder formed therein. An oil injector is connected to the engine to provide lubricating oil to the at least one cylinder and is in fluid communication with an oil supply. The engine includes an ECU programmed to control an amount of oil introduced into the engine wherein, a first amount of oil is introduced into the engine based on a normal operation, and a second amount of oil, greater than the first amount of oil, is introduced into the engine based on a storage preparation operation.

According to another embodiment of the present invention, an outboard motor includes an engine, a midsection extending from the engine, and a gear case attached to the midsection. A propeller shaft extends from the gearcase and is constructed to be driven by the engine. The outboard motor has an ECU programmed to initiate an oil delivery to the engine during engine operation and constructed to receive a storage signal. In response to the storage signal, the ECU is further programmed to initiate an auto-fogging procedure.

In accordance with another embodiment of the present invention, a method of preparing an engine for storage includes the steps of: providing an ECU with a storage routine, initializing the storage routine, and increasing an amount of lubricant introduced into an engine during the storage routine.

The present invention has been described in terms of the preferred embodiment, and it is recognized that equivalents, alternatives, and modifications, aside from those expressly stated, are possible and within the scope of the appending claims. While the present invention is shown as being incorporated into an outboard motor, the present invention is equally applicable with other recreational products, some of which include inboard motors, snowmobiles, personal watercrafts, all-terrain vehicles (ATVs), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger vehicles such as sports utility vehicles (SUV).

What is claimed is:

1. An engine comprising:

a block having at least one cylinder formed therein;

an oil injector connected to the engine to provide lubricating oil to the at least one cylinder;

an oil supply in fluid communication with the oil injector; and an ECU programmed to control an amount of oil introduced into the engine by the oil injector, wherein a first amount of oil is introduced into the engine by the oil injector based on a normal operation and a second amount of oil, greater than the first amount of oil, is introduced into the engine by the oil injector based on a storage preparation operation.

2. The engine of claim 1 further comprising an oil pump controlled by the ECU and fluidly connected to the oil supply and the oil injector.

3. The engine of claim 1 wherein the ECU is further programmed to receive an indication of a neutral position and an indication of an engine idle speed and upon receiving both indicia for at least a predetermined time period, the ECU initiates the storage preparation operation.

4. The engine of claim 1 wherein the ECU is programmed to provide an indication of the storage preparation operation.

5. The engine of claim 4 wherein the indication is via a plurality of lights and wherein the ECU is programmed to indicate that the storage preparation operation has commenced.

6. The engine of claim 4 wherein the plurality of lights are toggled on and off to indicate an elapsed time of throttle position.

7. The engine of claim 1 wherein the storage preparation operation is performed while the engine is running and wherein the ECU is programmed to shut off the engine after completion of the storage preparation operation.

8. The engine of claim 1 wherein the engine is a two-cycle engine and is incorporated into at least one of an outboard motor, a watercraft, a snowmobile, an ATV, a motorcycle, a scooter, and lawnigarden equipment.

9. The engine of claim 1 wherein the ECU is further programmed to disregard a throttle position signal above a predetermined value upon commencing the storage preparation operation.

10. The engine of claim 9 wherein the predetermined value is indicative of at least a six percent open throttle plate.

11. The engine of claim 1 wherein the ECU is programmed to receive a throttle position sensor signal and a transmission position signal and if the throttle position sensor signal is greater than a predetermined value and the transmission position signal is indicative of a neutral position for a predetermined time, the ECU is programmed to provide a storage preparation operation initialization indication.

12. The engine of claim 11 wherein the predetermined value of the throttle position sensor is at least one volt and the predetermined time is at least five seconds.

13. The engine of claim 11 wherein multiple changes in the throttle position, each for the predetermined time, cause the ECU to generate the storage preparation operation initialization indication.

14. An outboard motor comprising:

an engine;

a midsection extending from the engine:

a gearcase attached to the midsection and having a propeller shaft extending therefrom, the propeller shaft constructed to be driven by the engine;

an ECU programmed to initiate an oil delivery to the engine during engine operation and programmed to receive a storage signal, the ECU, In response to the storage signal, is further programmed to initiate an auto-fogging procedure; and an oil pump controlled by the ECU and constructed to deliver (1) an amount of oil to the engine from a reservoir during normal operation, and (2) a larger amount of oil to the engine in response to the storage signal as at least a part of the auto-fogging procedure.

15. The outboard motor of claim 14 wherein the ECU monitors a throttle position and a transmission position.

16. The outboard motor of claim 15 wherein the ECU is further programmed to provide an indication that the throttle position is idle and the transmission is in neutral for a predetermined period.

17. The outboard motor of claim 16 wherein if the throttle position is increased after the indication and the transmission is in neutral for a predetermined time, the ECU is further programmed to provide a second indication.

18. The outboard motor of claim 17 wherein if after the second indication is provided, the throttle position is reduced, and the transmission is in neutral for a predetermined time, the ECU commences the auto-fogging procedure.

19. The outboard motor of claim 18 wherein the ECU is further programmed to check for an increase in throttle position before commencing the auto-fogging procedure.

20. The outboard motor of claim 14 wherein the storage signal is at least one of initiated by, monitored by, and controlled by a diagnostic tool external to the outboard motor.

21. The outboard motor of claim 14 wherein the ECU is programmed to perform the auto-fogging procedure while the engine is running and to automatically shut off the engine after the auto-fogging procedure is complete, wherein the engine is deemed ready for storage.

22. The outboard motor of claim 14 wherein the ECU is further programmed to provide an indication of initialization of the auto-fogging procedure.

23. The outboard motor of claim 22 wherein the indication is one of an acoustical indicator and a visible indicator.

24. The outboard motor of claim 23 wherein the visible indicator includes systematically lighting at least one of an engine temperature light, a fuel indicator light, and a battery condition light.

25. A method of preparing an engine for storage comprising the steps of:

providing an ECU with a storage routine;

providing an oil pump controlled by the ECU;

initializing the storage routine; and increasing an amount of lubricant introduced into the engine by the oil pump beyond that needed for normal operation during the storage routine.

26. The method of claim 25 wherein the step of initializing the storage routine is at least one of receiving a storage routine initialization signal or generating a storage routine initialization signal.

27. The method of claim 25 further comprising the step of automatically shutting down the engine after completion of the storage routine.

28. The method of claim 25 further comprising indicating acceptance of the storage routine initialization signal.

29. The method of claim 28 wherein Indicating acceptance of the initialization signal is communicated through at least one engine condition light.

30. The method of claim 25 wherein the storage routine initialization signal is derived from at least one of a position of a throttle and automatically initiating the routine when the engine is idling in neutral.

31. The method of claim 25 wherein if the engine is at least one of above idle and engaged with a transmission, the routine initialization signal is disregarded.

32. The method of claim 25 wherein the step of increasing an amount of lubricant into the engine includes automatically adjusting an engine speed to maintain engine operation.

33. The method of claim 25 wherein the step of increasing an amount of lubricant into the engine includes introducing the increased amounts of lubricant directly into a crankcase of an engine.

34. The method of claim 25 wherein the increased amount of lubrication is introduced for a predetermined time.

35. The method of claim 25 wherein the storage routine initialization signal is induced by at least one of an operator and a diagnostic tool.

* * * * *